US008322150B2

(12) United States Patent
Mitra et al.

(10) Patent No.: US 8,322,150 B2
(45) Date of Patent: Dec. 4, 2012

(54) REFRIGERATING SYSTEM WITH PARALLEL STAGED ECONOMIZER CIRCUITS DISCHARGING TO INTERSTAGE PRESSURES OF A MAIN COMPRESSOR

(75) Inventors: Biswajit Mitra, Charlotte, NC (US); Wayne P. Beagle, Chittenango, NY (US); James W. Bush, Skaneateles, NY (US)

(73) Assignee: Carrier Corporation, Farmington, CT (US)

( * ) Notice: Subject to any disclaimer, the term of this patent is extended or adjusted under 35 U.S.C. 154(b) by 502 days.

(21) Appl. No.: 12/225,654

(22) PCT Filed: Mar. 27, 2006

(86) PCT No.: PCT/US2006/011100

§ 371 (c)(1),
(2), (4) Date: May 21, 2010

(87) PCT Pub. No.: WO2007/111595

PCT Pub. Date: Oct. 4, 2007

(65) Prior Publication Data

US 2010/0223939 A1 Sep. 9, 2010

(51) Int. Cl.
*F25B 5/00* (2006.01)

(52) U.S. Cl. ..... 62/117; 62/510; 62/513

(58) Field of Classification Search ..... 62/117, 62/115, 510, 513, 498, 434; 418/5
See application file for complete search history.

(56) References Cited

U.S. PATENT DOCUMENTS

| | | | | |
|---|---|---|---|---|
| 3,580,006 | A | | 5/1971 | Quick |
| 3,766,745 | A | | 10/1973 | Quick |
| 3,954,430 | A | * | 5/1976 | Curtis et al. ..... 62/619 |
| 4,197,719 | A | | 4/1980 | Shaw |
| 4,232,533 | A | * | 11/1980 | Lundblad et al. ..... 62/509 |
| 4,254,637 | A | | 3/1981 | Brauch et al. |
| 4,947,655 | A | * | 8/1990 | Shaw ..... 62/200 |
| 5,265,434 | A | | 11/1993 | Alsenz |
| 5,522,233 | A | * | 6/1996 | Nares et al. ..... 62/193 |
| 6,058,727 | A | * | 5/2000 | Fraser et al. ..... 62/190 |
| 6,105,378 | A | | 8/2000 | Shaw |
| 6,131,401 | A | | 10/2000 | Ueno et al. |

(Continued)

FOREIGN PATENT DOCUMENTS

EP 0845642 A2 6/1998

OTHER PUBLICATIONS

Extended European Search Report, Supplementary European Search Report and European Search Opinion for International Application No. PCT-US2006/011100, Nov. 14, 2011, 5 pages.

*Primary Examiner* — Mohammad Ali
(74) *Attorney, Agent, or Firm* — Cantor Colburn LLP

(57) ABSTRACT

A refrigeration system (20A) comprises an evaporator (27) for evaporating a refrigerant, a two-stage compressor (32) for compressing the refrigerant, a single-stage compressor (34) for compressing the refrigerant, a heat rejecting heat exchanger (24) for cooling the refrigerant, a first economizer circuit (25A), and a second economizer circuit (25B). The first economizer circuit (25A) is configured to inject refrigerant into an interstage port (48) of the two-stage compressor (32). The second economizer circuit (25B) is configured to inject refrigerant into a suction port (52) of the single-stage compressor (34). The single-stage compressor (34) is configured to discharge into the interstage port (48) of the two-stage compressor (32).

20 Claims, 10 Drawing Sheets

U.S. PATENT DOCUMENTS 6,145,326 A 11/2000 O'Brien
6,185,946 B1 2/2001 Hartman
6,718,781 B2 * 4/2004 Freund et al. ..... 62/199
6,895,781 B2 * 5/2005 Dobmeier et al. ..... 62/513
6,938,430 B2 9/2005 Tanimoto et al.
6,955,058 B2 * 10/2005 Taras et al. ..... 62/175
7,451,617 B2 11/2008 Renz et al.
2002/0021972 A1 2/2002 Vaisman
2004/0035122 A1 2/2004 Lifson et al.
2008/0104981 A1 5/2008 Heinbokel et al.

* cited by examiner

REFRIGERATING SYSTEM WITH PARALLEL STAGED ECONOMIZER CIRCUITS DISCHARGING TO INTERSTAGE PRESSURES OF A MAIN COMPRESSOR

BACKGROUND OF THE INVENTION

The present invention relates generally to refrigerating systems used for cooling. More particularly, the present invention relates to a refrigerating system that incorporates economizer circuits to increase system efficiency.

A typical refrigerating system includes an evaporator, a compressor, a condenser, and a throttle valve. A refrigerant, such as a hydrofluorocarbon (HFC), typically enters the evaporator as a two-phase liquid-vapor mixture. Within the evaporator, the liquid portion of the refrigerant changes phase from liquid to vapor as a result of heat transfer into the refrigerant. The refrigerant is then compressed within the compressor, thereby increasing the pressure of the refrigerant. Next, the refrigerant passes through the condenser, where it changes phase from a vapor to a liquid as it cools within the condenser. Finally, the refrigerant expands as it flows through the throttle valve, which results in a decrease in pressure and a change in phase from a liquid to a two-phase liquid-vapor mixture.

While natural refrigerants such as carbon dioxide have recently been proposed as alternatives to the presently used HFCs, the high side pressure of carbon dioxide typically ends up in the supercritical region where there is no transition from vapor to liquid as the high pressure refrigerant is cooled. For a typical single stage vapor compression cycle, this leads to poor efficiency due to the loss of the subcritical constant temperature condensation process and to the relatively high residual enthalpy of supercritical carbon dioxide at normal high side temperatures.

Thus, there exists a need for a refrigerating system that is capable of utilizing any refrigerant, including a transcritical refrigerant, while maintaining a high level of system efficiency.

BRIEF SUMMARY OF THE INVENTION

The present invention is a refrigeration system comprising an evaporator for evaporating a refrigerant, a two-stage compressor for compressing the refrigerant, a single-stage compressor for compressing the refrigerant, a heat rejecting heat exchanger for cooling the refrigerant, a first economizer circuit, and a second economizer circuit. The first economizer circuit is configured to inject refrigerant into an interstage port of the two-stage compressor. The second economizer circuit is configured to inject refrigerant into a suction port of the single-stage compressor. The single-stage compressor is configured to discharge into the interstage port of the two-stage compressor.

DETAILED DESCRIPTION

Figure 1A:
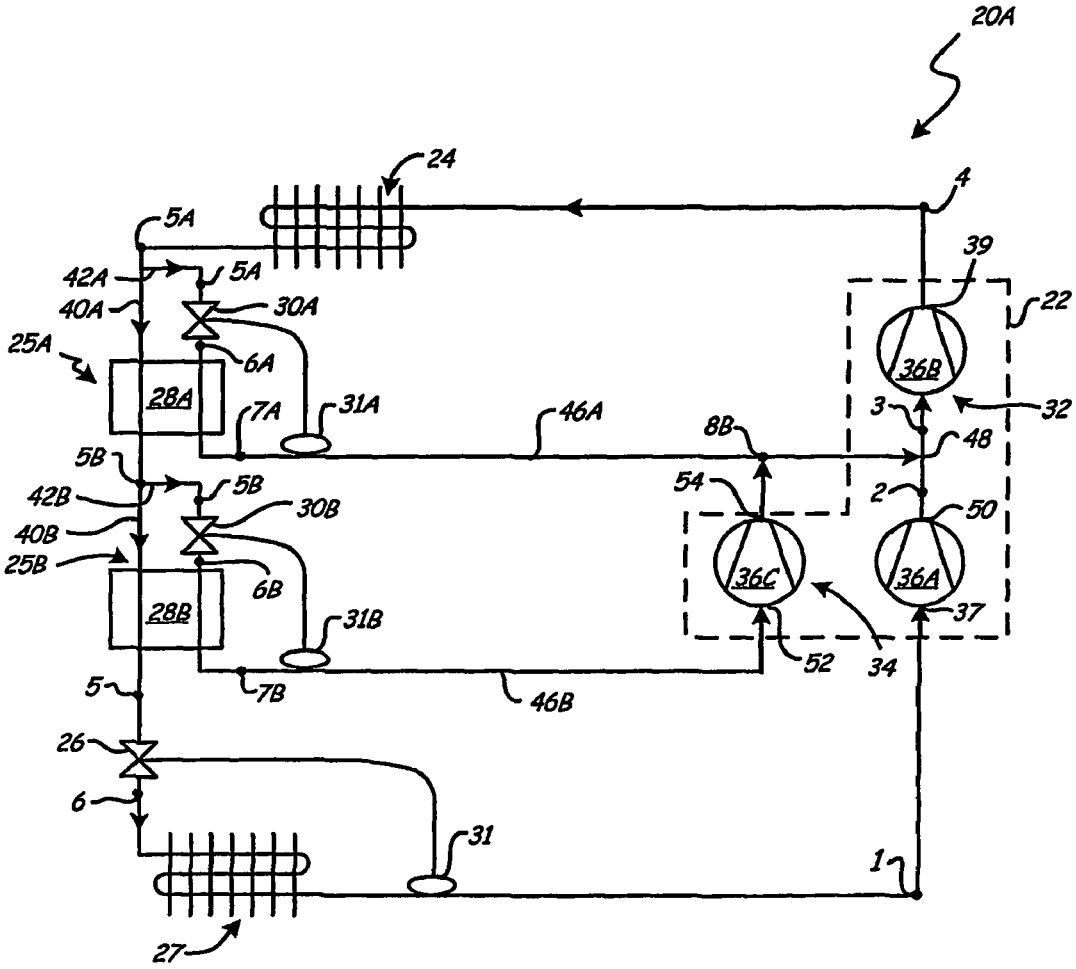
FIG. 1A illustrates a schematic diagram of a refrigeration system employing a pair of economizer heat exchangers.

FIG. 1A illustrates a schematic diagram of refrigeration system 20A, which includes compressor unit 22, heat rejecting heat exchanger 24, first economizer circuit 25A, second economizer circuit 25B, main expansion valve 26, evaporator 27, and sensor 31. First economizer circuit 25A includes first economizer heat exchanger 28A, expansion valve 30A, and sensor 31A, while second economizer circuit 25B includes second economizer heat exchanger 28B, expansion valve 30B, and sensor 31B. As shown in FIG. 1A, first economizer heat exchanger 28A and second economizer heat exchanger 28B are parallel flow tube-in-tube heat exchangers.

Compressor unit 22 includes two-stage compressor 32 and single-stage compressor 34. Two-stage compressor 32 includes cylinders 36A and 36B connected in series, while single-stage compressor 34 includes cylinder 36C. Two-stage compressor 32 and single-stage compressor 34 may be stand-alone compressor units, or they may be part of a single, multi-cylinder compressor unit. In addition, two-stage compressor 32 and single-stage compressor 34 are preferably reciprocating compressors, although other types of compressors may be used including, but not limited to, scroll, screw, rotary vane, standing vane, variable speed, hermetically sealed, and open drive compressors.

In refrigeration system 20A, three distinct refrigerant paths are formed by connection of the various elements in the system. A main refrigerant path is defined by the route between points 1, 2, 3, 4, 5, and 6. A first economized refrigerant path is defined by the route between points 5A, 6A, 7A, 3, and 4. Finally, a second economized refrigerant path is defined by the route between points 5B, 6B, 7B, 8B, 3, and 4. It should be understood that the paths are all closed paths that allow for continuous flow of refrigerant through refrigeration system 20A.

In reference to the main refrigerant path, after refrigerant exits two-stage compressor 32 at high pressure and enthalpy through discharge port 39 (point 4), the refrigerant loses heat in heat rejecting heat exchanger 24, exiting heat rejecting heat exchanger 24 at low enthalpy and high pressure (point 5A). The refrigerant then splits into two flow paths 40A and 42A prior to entering first economizer heat exchanger 28A. The main path continues along paths 40A and 40B through first economizer heat exchanger 28A (point 5B) and second economizer heat exchanger 28B (point 5), respectively. As the refrigerant in path 40A flows through first economizer heat exchanger 28A, it is cooled by the refrigerant in path 42A of the first economized path. Similarly, as the refrigerant in path 40B flows through second economizer heat exchanger 28B, it is cooled by the refrigerant in path 42B of the second economized path.

Refrigerant from path 40B is then throttled in main expansion valve 26. Main expansion valve 26, along with economizer expansion valves 30A and 30B, are preferably thermal expansion valves (TXV) or electronic expansion valves (EXV). After going through an expansion process within main expansion valve 26 (point 6), the refrigerant is a two-phase liquid-vapor mixture and is directed toward evaporator 27. After evaporation of the remainder of the liquid (point 1), the refrigerant enters two-stage compressor 32 through suction port 37. The refrigerant is compressed within cylinder 36A, which is the first stage of two-stage compressor 32, and is then directed out discharge port 50 (point 2), where it merges with the cooler refrigerant from economizer return path 46A that is injected into interstage port 48 (point 3). Thus, the refrigerant from economizer return path 46A functions to cool down the refrigerant discharged from cylinder 36A prior to the second stage of compression within cylinder 36B. After the second stage of compression, the refrigerant is discharged through discharge port 39 (point 4).

In reference to the first economized path, after refrigerant exits heat rejecting heat exchanger 24 at low enthalpy and high pressure (point 5A) and splits into two flow paths 40A and 42A, the first economized path continues along path 42A. In path 42A, the refrigerant is throttled to a lower pressure by economizer expansion valve 30A (point 6A) prior to flowing through first economizer heat exchanger 28A. The refrigerant from path 42A that flowed through first economizer heat exchanger 28A (point 7A) is then directed along economizer return path 46A and injected into interstage port 48 of two-stage compressor 32 where it merges with refrigerant flowing through the main path to cool down the refrigerant (point 3) prior to a second stage of compression in cylinder 36B.

In reference to the second economized path, after being cooled in the higher pressure first economizer heat exchanger 28A (point 5B), the refrigerant in path 40A splits into two flow paths 40B and 42B. The second economized path continues along flow path 42B where the refrigerant is throttled to a lower pressure by economizer expansion valve 30B (point 6B) prior to flowing through second economizer heat exchanger 28B. The refrigerant from path 42B that flowed through second economizer heat exchanger 28B (point 7B) is then directed along economizer return path 46B and injected into suction port 52 of single-stage compressor 34 for compression in single-stage compressor 34. After compression within single-stage compressor 34, the refrigerant is discharged through discharge port 54 where it is mixed with the refrigerant in economizer return path 46A (point 8B) prior to injection into interstage port 48 of two-stage compressor 32 (point 3).

Refrigeration system 20A also includes sensor 31 disposed between evaporator 27 and compressor unit 22 along the main refrigerant path. In general, sensor 31 acts with expansion valve 26 to sense the temperature of the refrigerant leaving evaporator 27 and the pressure of the refrigerant in evaporator 27 to regulate the flow of refrigerant into evaporator 27 to keep the combination of temperature and pressure within some specified bounds. In a preferred embodiment, expansion valve 26 is an electronic expansion valve and sensor 31 is a temperature transducer such as a thermocouple or thermistor. In another embodiment, expansion valve 26 is a mechanical thermal expansion valve and sensor 31 includes a small tube that terminates in a pressure vessel-filled with a refrigerant that differs from the refrigerant running through refrigeration system 20A. As refrigerant from evaporator 27 flows past sensor 31 on its way toward compressor unit 22, the pressure vessel will either heat up or cool down, thereby changing the pressure within the pressure vessel. As the pressure in the pressure vessel changes, sensor 31 sends a signal to expansion valve 26 to modify the pressure drop caused by the valve. Similarly, in the case of the electronic expansion valve, sensor 31 sends an electrical signal to expansion valve 26 which responds in a similar manner to regulate refrigerant flow. For example, if a return gas coming from evaporator 27 is too hot, sensor 31 will then heat up and send a signal to expansion valve 26, causing the valve to open further and allow more refrigerant per unit time to flow through evaporator 27, thereby reducing the heat of the refrigerant exiting evaporator 27.

Economizer circuits 25A and 25B also include sensors 31A and 31B, respectively, that operate in a similar manner to sensor 31. However, sensors 31A and 31B sense temperature along economizer return paths 46A and 46B and act with expansion valves 30A and 30B to control the pressure drops within expansion valves 30A and 30B instead. It should also be noted that various other sensors may be substituted for sensors 31, 31A, and 31B without departing from the spirit and scope of the present invention.

By controlling the expansion valves 26, 30A, and 30B, the operation of refrigeration system 20A can be adjusted to meet the cooling demands and achieve optimum efficiency. In addition to adjusting the pressures associated with expansion valves 26, 30A, and 30B, the displacements of cylinders 36A, 36B, and 36C may also be adjusted to help achieve optimum efficiency of refrigeration system 20A.

Figure 1B:
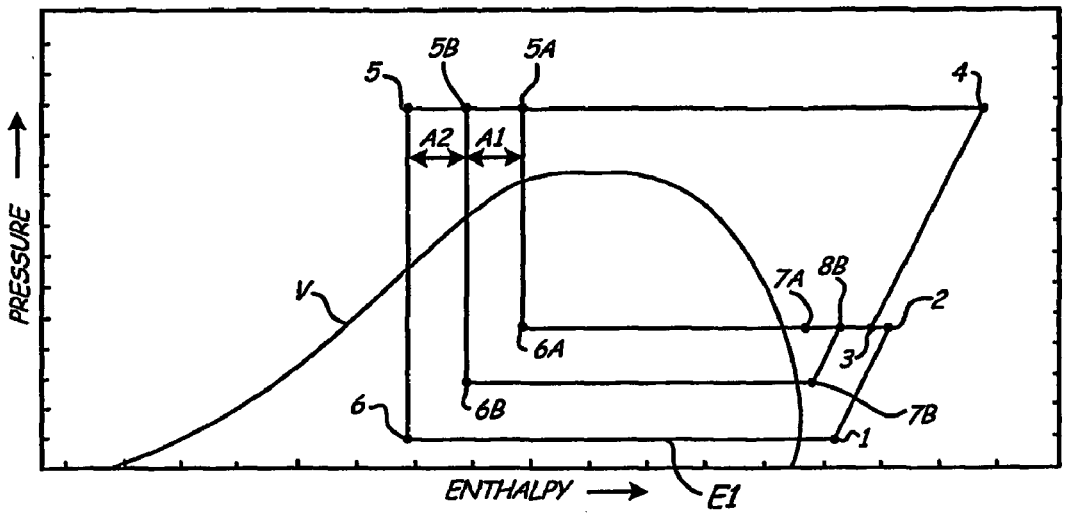
FIG. 1B illustrates a graph relating enthalpy to pressure for the refrigeration system of FIG. 1A.

FIG. 1B illustrates a graph relating enthalpy to pressure for the refrigeration system 20A of FIG. 1A. Vapor dome V is formed by a saturated liquid line and a saturated vapor line, and defines the state of the refrigerant at various points along the refrigeration cycle. Underneath vapor dome V, all states involve both liquid and vapor coexisting at the same time. At the very top of vapor dome V is the critical point. The critical point is defined by the highest pressure where saturated liquid and saturated vapor coexist. In general, compressed liquids are located to the left of vapor dome V, while superheated vapors are located to the right of vapor dome V.

In FIG. 1B, the main refrigerant path is defined by the route between points 1, 2, 3, 4, 5, and 6; the first economized path is defined by the route between points 5A, 6A, 7A, 3, and 4; and the second economized path is defined by the route between points 5B, 6B, 7B, 8B, 3, and 4. The cycle begins in the main path at point 1, where the refrigerant is at a low pressure and high enthalpy prior to entering compressor unit 22. After a first stage of compression within cylinder 36A of two-stage compressor 32, both the enthalpy and pressure increase as shown by point 2. Next, the refrigerant is cooled down by the refrigerant injected into interstage port 48 from the first and second economized paths, as shown by point 3. After a second stage of compression within cylinder 36B, the refrigerant exits compressor unit 22 at high pressure and even higher enthalpy, as shown by point 4. Then, as the refrigerant flows through heat rejecting heat exchanger 24, enthalpy decreases while pressure remains constant. Prior to entering first economizer heat exchanger 28A, the refrigerant splits into a main portion and a first economized portion as shown by point 5A. Similarly, prior to entering second economizer heat exchanger 28B, a second economized portion is diverted from the main portion as shown by point 5B. The first and second economized portions will be discussed in more detail below. The main portion is then throttled in main expansion valve 26, decreasing pressure as shown by point 6. Finally, the main portion of the refrigerant is evaporated, exiting evaporator 27 at a higher enthalpy as shown by point 1.

As stated previously, the first economized portion splits off of the main portion as indicated by point 5A. The first economized portion is throttled to a lower pressure in expansion valve 30A as shown by point 6A. The first economized portion of the refrigerant then exchanges heat with the main portion in first economizer heat exchanger 28A, cooling down the main portion of the refrigerant as indicated by point 5B, and heating up the first economized portion of the refrigerant as indicated by point 7A. The first economized portion then merges with the second economized portion at point 8B and with the main portion at point 3, cooling down the refrigerant prior to a second stage of compression in cylinder 36B as described above.

As stated previously, the second economized portion splits off of the main portion as indicated by point 5B. The second economized portion is throttled to a lower pressure in expansion valve 30B as shown by point 6B. The second economized portion of the refrigerant then exchanges heat with the main portion within second economizer heat exchanger 28B, cooling down the main portion of the refrigerant to its lowest temperature as indicated by point 5, and heating up the second economized portion of the refrigerant as indicated by point 7B. The second economized portion is then compressed within single-stage compressor 34 and discharged into the first economized portion, as shown by point 8B. Finally, the combined first and second economized portions merge with the main portion at point 3 prior to the second stage of compression within cylinder 36B.

In a refrigeration system, the specific cooling capacity, which is the measure of total cooling capacity divided by refrigerant mass flow, may typically be represented on a graph relating pressure to enthalpy by the length of the evaporation line. Furthermore, when the specific cooling capacity is divided by the specific power input to the compressor, the result is the system efficiency. In general, a high specific cooling capacity achieved by inputting a low specific power to the compressor will yield a high efficiency.

As shown in FIG. 1B, the specific cooling capacity of refrigeration system 20A is represented by the length of evaporation line E1 from point 6 to point 1. Lines A1 and A2 represent the increased specific cooling capacity due to the addition of the first economizer circuit 25A and second economizer circuit 25B, respectively. This indicates that refrigeration system 20A, which includes two economizer circuits, has a larger specific cooling capacity than a refrigeration system with no economizer circuits. Along with the increase in specific cooling capacity also comes an increase in specific power consumption. The increase in specific power consumption is a result of the additional compression of the economized flow shown between points 7B and 8B as well as between points 3 and 4. However, since the economized vapor is compressed over a smaller pressure range than the main portion of refrigerant, the added compression power is less than the added capacity. Therefore, the ratio of capacity to power (the efficiency) is increased by the addition of the two economizer circuits.

Figure 2A:
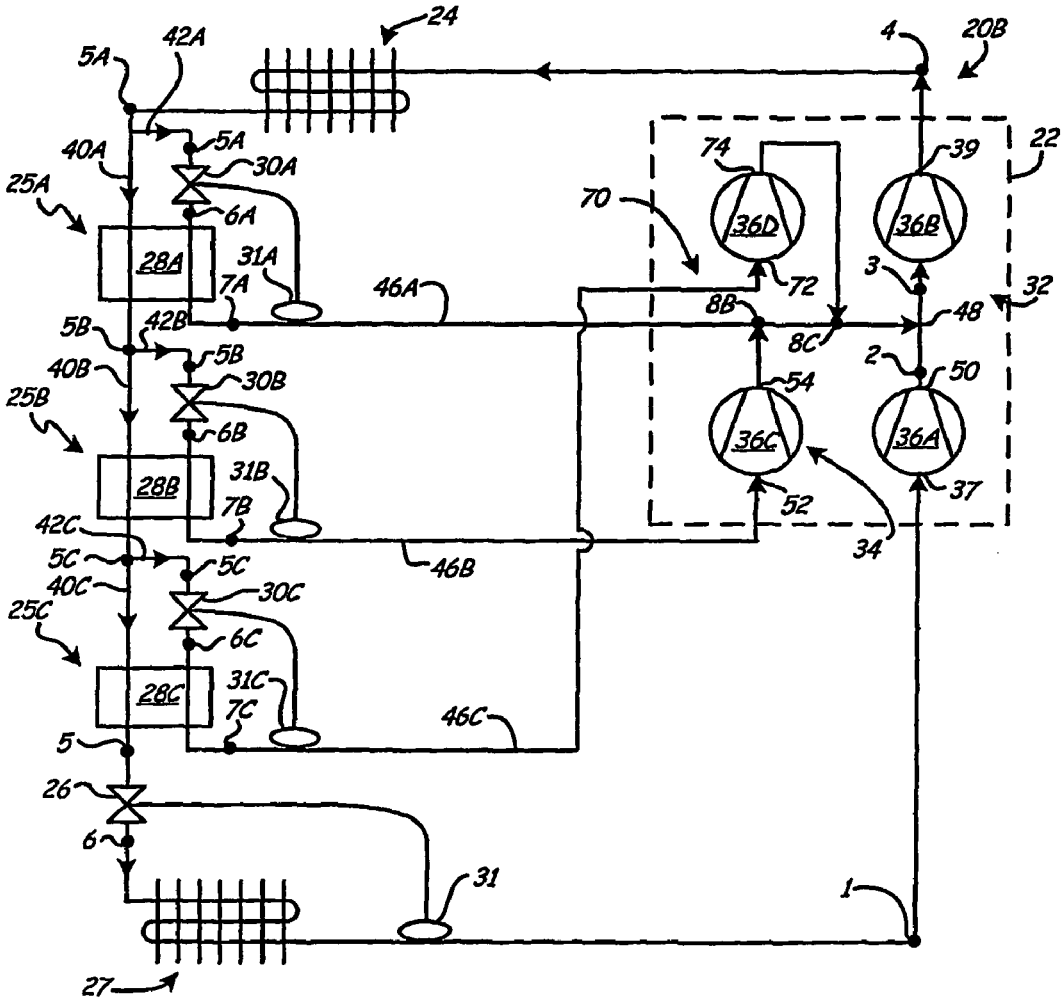
FIG. 2A illustrates a schematic diagram of a refrigeration system employing three economizer circuits.

FIG. 2A illustrates a schematic diagram of refrigeration system 20B of the present invention employing three economizer circuits. Refrigeration system 20B is similar to refrigeration system 20A, except that single-stage compressor 70 is added to compressor unit 22, and third economizer circuit 25C is added to the system. Single-stage compressor 70 includes cylinder 36D.

In refrigeration system 20B, four distinct refrigerant paths are formed by connection of the various elements in the system. The main refrigerant path, the first economized refrigerant path, and the second economized refrigerant path are similar to those described above in reference to FIG. 1A. A third economized refrigerant path is defined by the route between points 5C, 6C, 7C, 8C, 3, and 4.

In reference to the third economized path, after being cooled in the higher pressure second economizer heat exchanger 28B, the refrigerant in path 40B splits into two flow paths 40C and 42C (point 5C). The third economized path continues along flow path 42C where the refrigerant is throttled to a lower pressure by economizer expansion valve 30C prior to flowing through third economizer heat exchanger 28C (point 6C). The refrigerant from path 42C that flowed through third economizer heat exchanger 28C (point 70) is then directed along economizer, return path 46C and injected into suction port 72 of single-stage compressor 70 for compression in single-stage compressor 70. After compression within single-stage compressor 70, the refrigerant is discharged through discharge port 74 (point 8C) where it is mixed with the refrigerant in economizer return path 46A prior to injection into interstage port 48 of two-stage compressor 32.

Figure 2B:
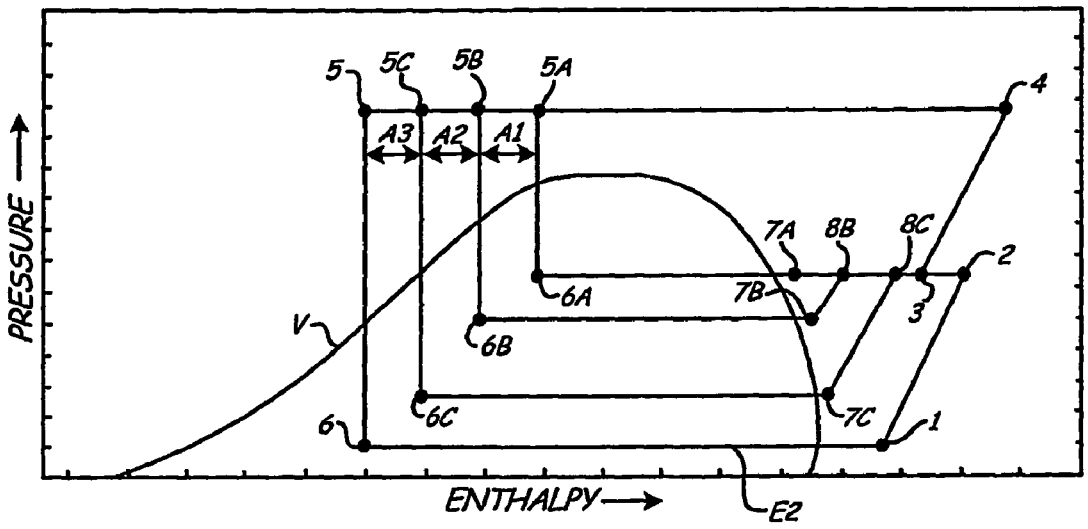
FIG. 2B illustrates a graph relating enthalpy to pressure for the refrigeration system of FIG. 2A.

FIG. 2B illustrates a graph relating enthalpy to pressure for the refrigeration system 20B of FIG. 2A. In FIG. 2B, the main refrigerant path is defined by the route between points 1, 2, 3, 4, 5, and 6; the first economized path is defined by the route between points 5A, 6A, 7A, 3, and 4; the second economized path is defined by the route between points 5B, 6B, 7B, 8B, 3, and 4; and the third economized path is defined by the route between points 5C, 6C, 7C, 8C, 3, and 4. As shown in FIG. 2B, evaporation line E2 of refrigeration system 20B is longer than evaporation line E1 of refrigeration system 20A (FIG. 1B). This indicates that refrigeration system 20B, which includes three economizer circuits, has a larger specific cooling capacity than refrigeration system 20A, which includes two economizer circuits. In particular, line A3 represents the increased specific cooling capacity due to the addition of the third economizer circuit.

Figure 3A:
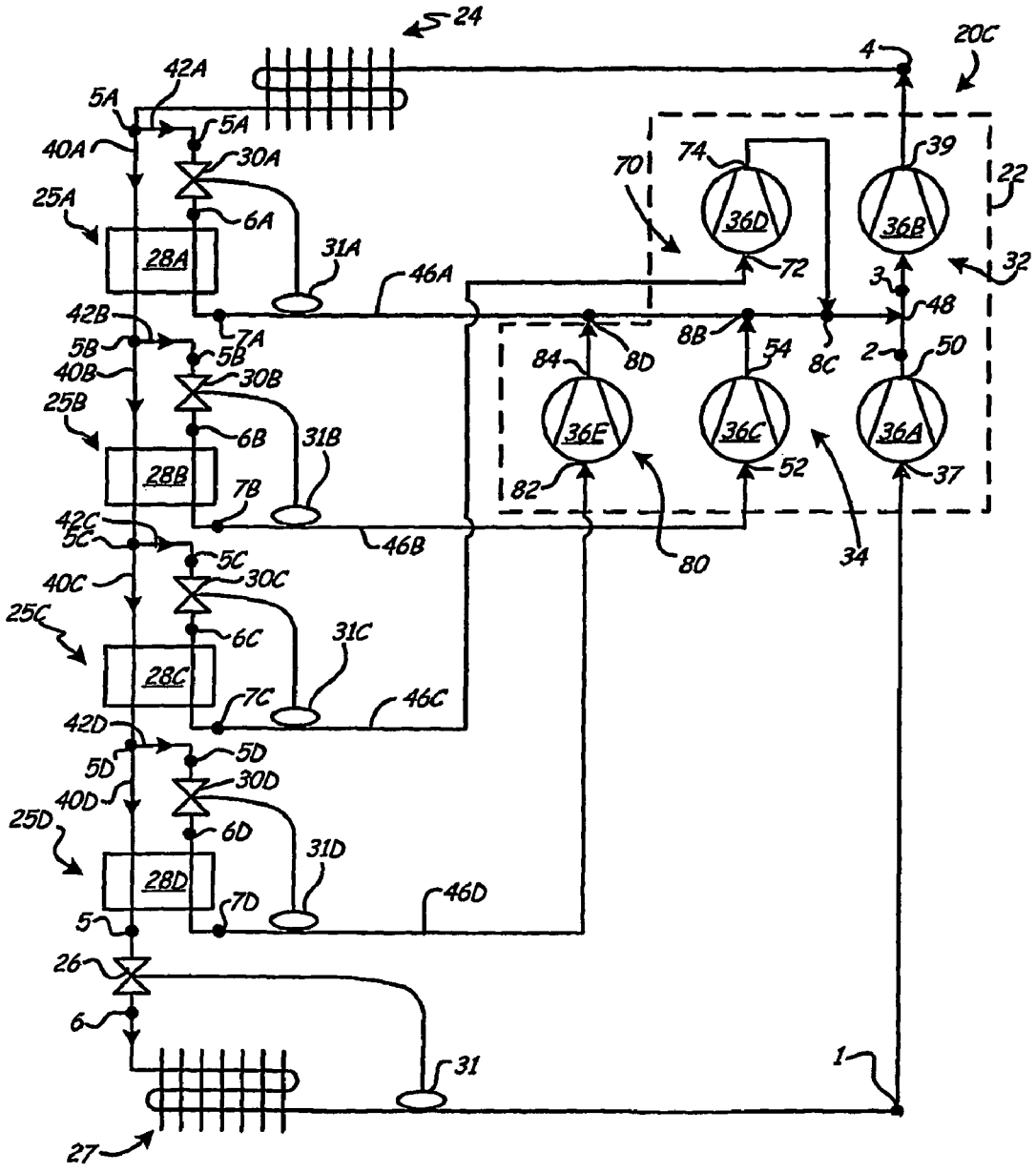
FIG. 3A illustrates a schematic diagram of a refrigeration system employing four economizer circuits.

FIG. 3A illustrates a schematic diagram of refrigeration system 20C of the present invention employing four economizer circuits. Refrigeration system 20C is similar to refrigeration system 20B, except that single-stage compressor 80 is added to compressor unit 22, and fourth economizer circuit 25D is added to the system. Single-stage compressor 80 includes cylinder 36E.

In refrigeration system 20C, five distinct refrigerant paths are formed by connection of the various elements in the system. The main refrigerant path, the first economized refrigerant path, the second economized refrigerant path, and the third economized refrigerant path are similar to those described above in reference to FIGS. 1A and 2A. A fourth economized refrigerant path is defined by the route between points 5D, 6D, 7D, 8D, 3, and 4.

In reference to the fourth economized path, after being cooled in the higher pressure third economizer heat exchanger 28C, the refrigerant in path 40C splits into two flow paths 40D and 42D (point 5D). The fourth economized path continues along flow path 42D where the refrigerant is throttled to a lower pressure by economizer expansion valve 30D prior to flowing through fourth economizer heat exchanger 28D (point 6D). The refrigerant from path 42D that flowed through fourth economizer heat exchanger 28D is then directed along economizer return path 46D (point 7D) and injected into suction port 82 of single-stage compressor 80 for compression in single-stage compressor 80. After compression within single-stage compressor 80 (point 8D), the refrigerant is discharged through discharge port 84 where it is mixed with the refrigerant in economizer return path 46A prior to injection into interstage port 48 of two-stage compressor 32.

Figure 3B:
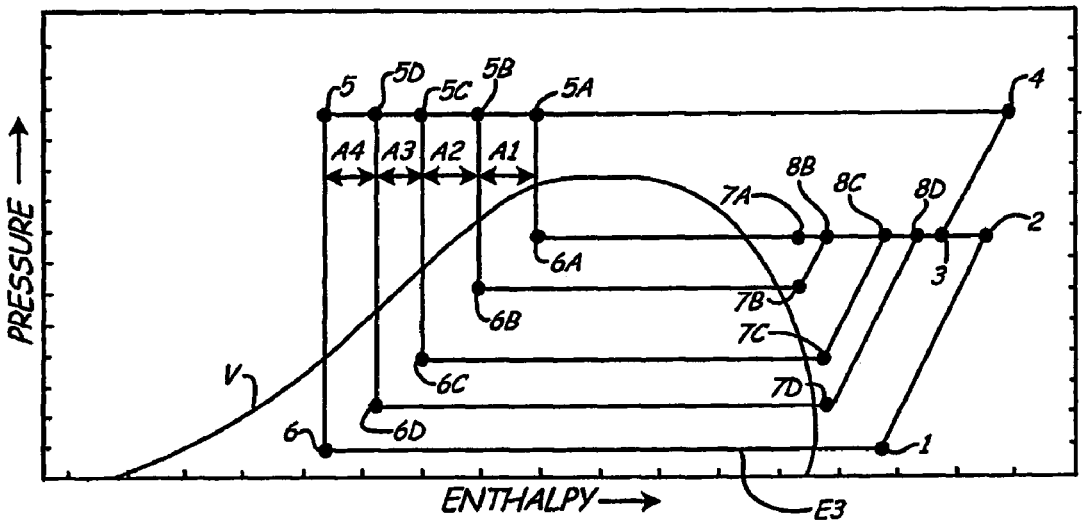
FIG. 3B illustrates a graph relating enthalpy to pressure for the refrigeration system of FIG. 3A.

FIG. 3B illustrates a graph relating enthalpy to pressure for the refrigeration system 20C of FIG. 3A. In FIG. 3B, the main refrigerant path is defined by the route between points 1, 2, 3, 4, 5, and 6; the first economized path is defined by the route between points 5A, 6A, 7A, 3, and 4; the second economized path is defined by the route between points 5B, 6B, 7B, 8B, 3, and 4; the third economized path is defined by the route between points 5C, 6C, 7C, 8C, 3, and 4; and the fourth economized path is defined by the route between points 5D, 6D, 7D, 8D, 3, and 4. As shown in FIG. 3B, evaporation line E3 of refrigeration system 20C is longer than evaporation line E2 of refrigeration system 20B (FIG. 2B). This indicates that refrigeration system 20C, which includes four economizer circuits, has a larger specific cooling capacity than refrigeration system 20B, which includes three economizer circuits. In particular, line A4 represents the increased specific cooling capacity due to the addition of the fourth economizer circuit.

Figure 4A:
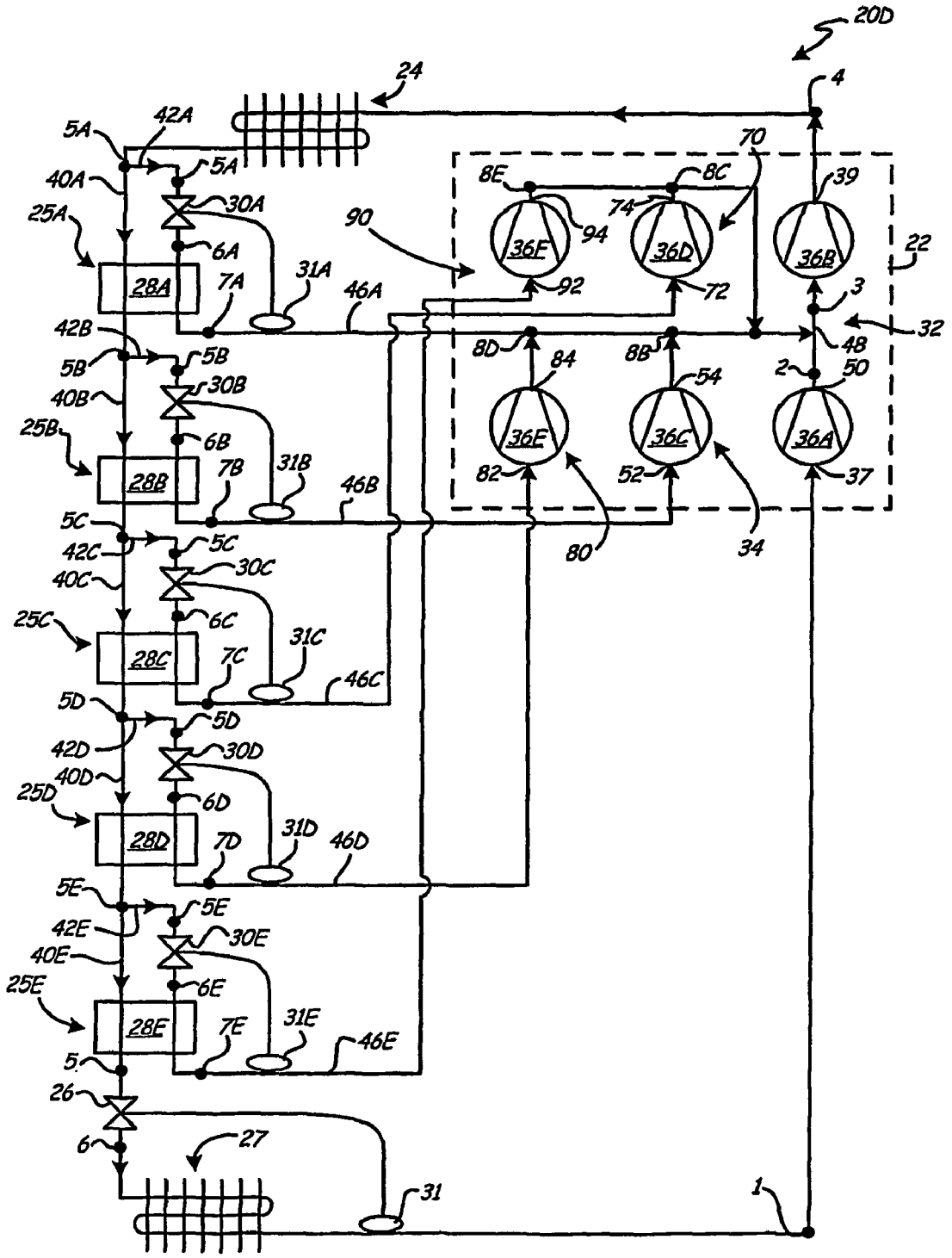
FIG. 4A illustrates a schematic diagram of a refrigeration system employing five economizer circuits.

FIG. 4A illustrates a schematic diagram of refrigeration system 20D of the present invention employing five economizer circuits. Refrigeration system 20D is similar to refrigeration system 20C, except that single-stage compressor 90 is added to compressor unit 22, and fifth economizer circuit 25E is added to the system. Single-stage compressor 90 includes cylinder 36F.

In refrigeration system 20D, six distinct refrigerant paths are formed by connection of the various elements in the system. The main refrigerant path, the first economized refrigerant path, the second economized refrigerant path, the third economized refrigerant path, and the fourth economized refrigerant path are similar to those described above in reference to FIGS. 1A, 2A, and 3A. A fifth economized refrigerant path is defined by the route between points 5E, 6E, 7E, 8E, 3, and 4.

In reference to the fifth economized path, after being cooled in the higher pressure fourth economizer heat exchanger 28D, the refrigerant in path 40D splits into two flow paths 40E and 42E (point 5E). The fifth economized path continues along flow path 42E where the refrigerant is throttled to a lower pressure by economizer expansion valve 30E prior to flowing through fifth economizer heat exchanger 28E (point 6E). The refrigerant from path 42E that flowed through fifth economizer heat exchanger 28E is then directed along economizer return path 46E (point 7E) and injected into suction port 92 of single-stage compressor 90 for compression in single-stage compressor 90. After compression within single-stage compressor 90, the refrigerant is discharged through discharge port 94 (point 8E) where it is mixed with the refrigerant in economizer return path 46A prior to injection into interstage port 48 of two-stage compressor 32.

Figure 4B:
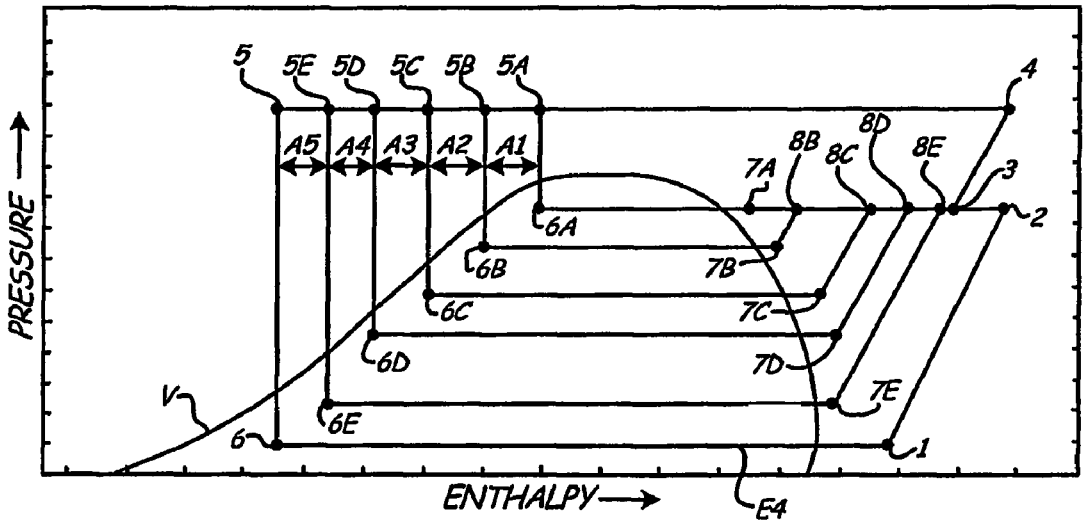
FIG. 4B illustrates a graph relating enthalpy to pressure for the refrigeration system of FIG. 4A.

FIG. 4B illustrates a graph relating enthalpy to pressure for the refrigeration system 20D of FIG. 4A. In FIG. 4B, the main refrigerant path is defined by the route between points 1, 2, 3, 4, 5, and 6; the first economized path is defined by the route between points 5A, 6A, 7A, 3, and 4; the second economized path is defined by the route between points 5B, 6B, 7B, 8B, 3, and 4; the third economized path is defined by the route between points 5C, 6C, 7C, 8C, 3, and 4; the fourth economized path is defined by the route between points 5D, 6D, 7D, 8D, 3, and 4; and the fifth economized path is defined by the route between points 5E, 6E, 7E, 8E, 3, and 4. As shown in FIG. 4B, evaporation line E4 of refrigeration system 20D is longer than evaporation line E3 of refrigeration system 20C (FIG. 3B). This indicates that refrigeration system 20D, which includes five economizer circuits, has a larger specific cooling capacity than refrigeration system 20C, which includes four economizer circuits. In particular, line A5 represents the increased specific cooling capacity due to the addition of the fifth economizer circuit.

Figure 5:
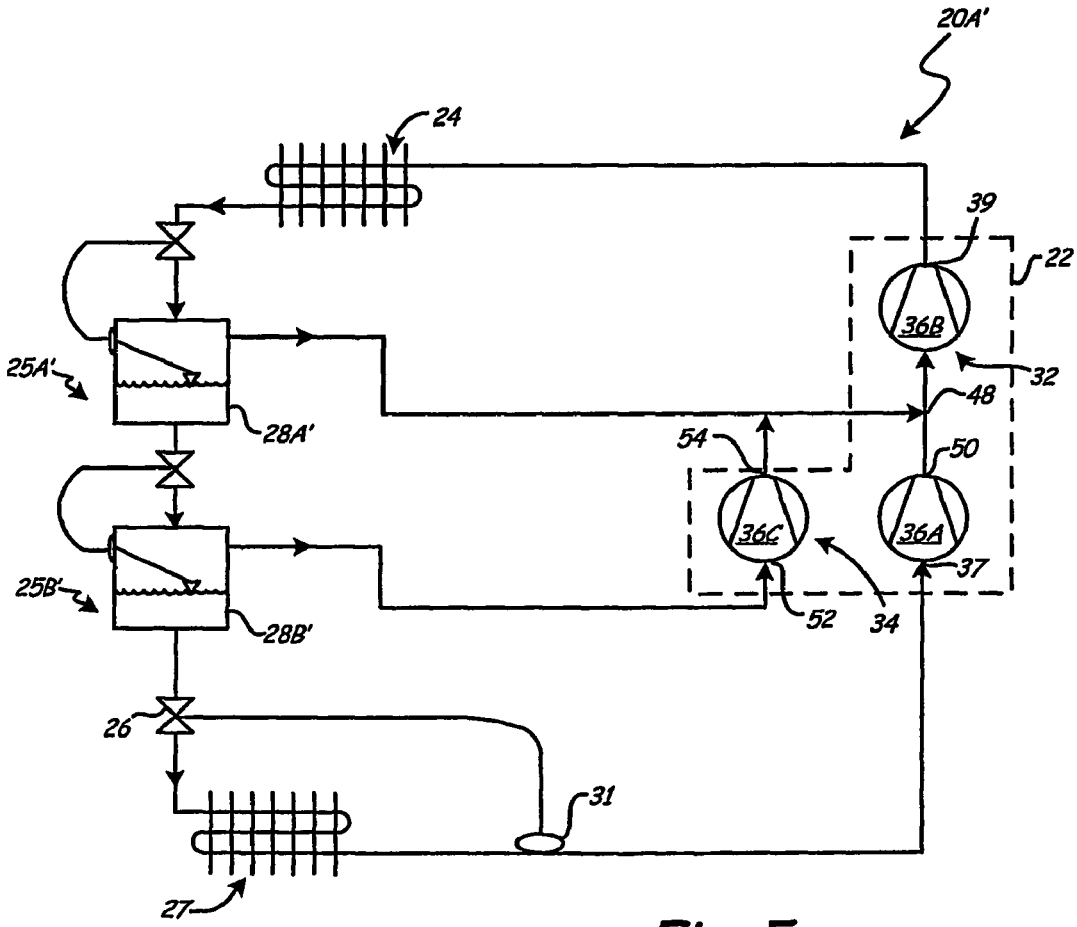
FIG. 5 illustrates a schematic diagram of an alternative embodiment of the refrigeration system of FIG. 1A.

FIG. 5 illustrates a schematic diagram of refrigeration system 20A', which is an alternative embodiment of refrigeration system 20A. In the embodiment shown in FIG. 5, first economizer heat exchanger 28A' and second economizer heat exchanger 28B' comprise flash tanks. Thus, as used in refrigeration system 20A', flash tanks are an alternative type of heat exchanger. As stated previously, in the embodiment shown in FIG. 1A, first and second economizer heat exchangers 28A and 28B are parallel flow tube-in-tube heat exchangers. However, parallel flow tube-in-tube heat exchangers may be replaced with flash tank type heat exchangers, as depicted in FIG. 5, without departing from the spirit and scope of the present invention.

Figure 6:
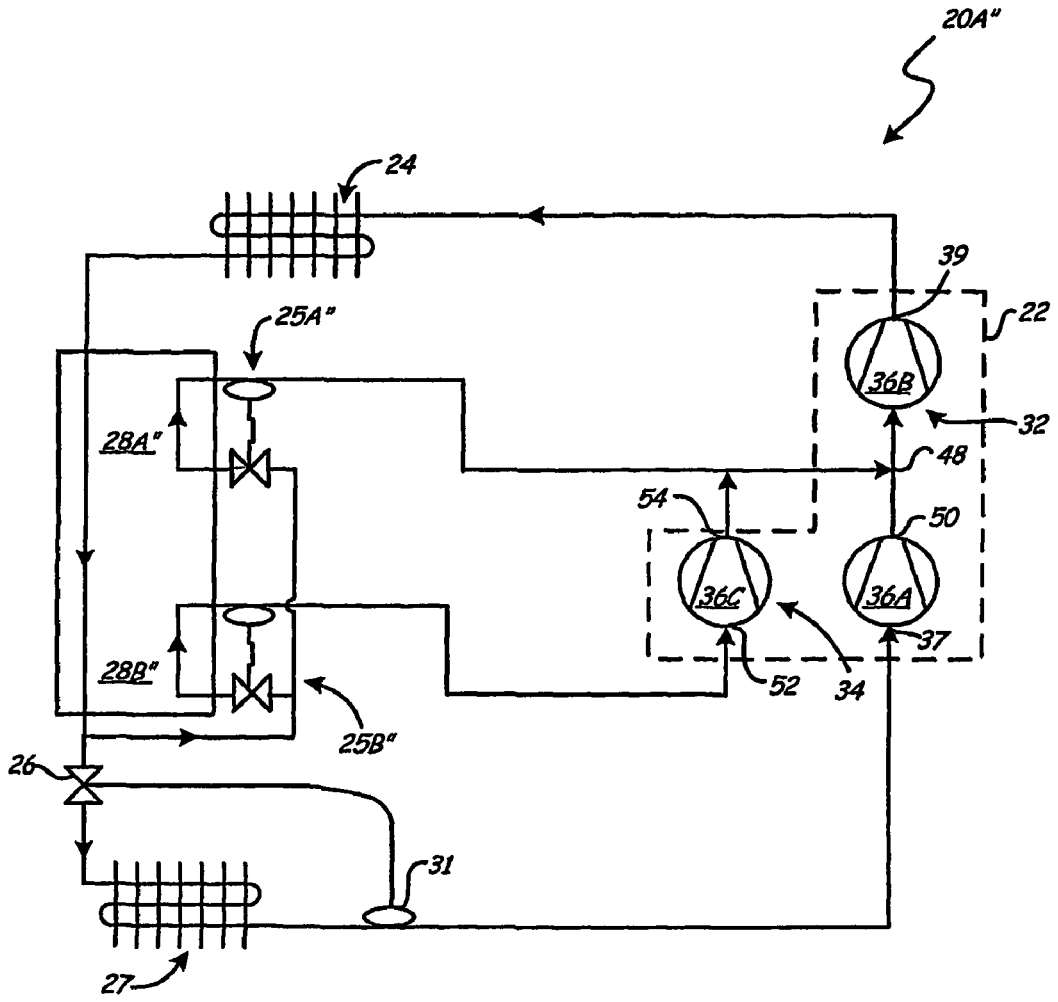
FIG. 6 illustrates a schematic diagram of another embodiment of the refrigeration system of FIG. 1A.

FIG. 6 illustrates a schematic diagram of refrigeration system 20A", which is another alternative embodiment of refrigeration system 20A. In the embodiment shown in FIG. 6, first economizer heat exchanger 28A" and second economizer heat exchanger 28B" form a brazed plate heat exchanger. However, substituting a brazed plate heat exchanger for parallel flow tube-in-tube heat exchangers does not substantially affect the overall system efficiency. Thus, a refrigeration system using a brazed plate heat exchanger is also within the intended scope of the present invention.

In addition to the parallel flow tube-in-tube heat exchangers, flash tanks, and brazed plate heat exchangers, numerous other heat exchangers may be used for the economizers without departing from the spirit and scope of the present invention. The list of alternative heat exchangers includes, but is not limited to, counter-flow tube-in-tube heat exchangers, parallel flow shell-in-tube heat exchangers, and counter-flow shell-in-tube heat exchangers.

Although the refrigeration system of the present invention is useful to increase system efficiency in a system using any type of refrigerant, it is especially useful in refrigeration systems that utilize transcritical refrigerants, such as carbon dioxide. Because carbon dioxide is such a low critical temperature refrigerant, refrigeration systems using carbon dioxide typically run transcritical. Furthermore, because carbon dioxide is such a high pressure refrigerant, there is more opportunity to provide multiple pressure steps between the high and low pressure portions of the circuit to include multiple economizers, each of which contributes to increase the efficiency of the system. Thus, the present invention may be used to increase the efficiency of systems utilizing transcritical refrigerants such as carbon dioxide, making their efficiency comparable to that of typical refrigerants. However, the refrigeration system of the present invention is useful to increase the efficiency in systems using any refrigerant, including those that run subcritical as well as those that run transcritical.

While the alternative embodiments of the present invention have been described as including a number of economizer circuits ranging from two to five, it should be understood that a refrigeration system with more than five economizer circuits is within the intended scope of the present invention. Furthermore, the economizer circuits may be connected to the compressors in various other combinations without decreasing system efficiency. Thus, refrigeration systems that utilize a greater number of economizer circuits or connect the economizer circuits in various other combinations are within the intended scope of the present invention. In addition, although the embodiments shown in FIGS. 1A, 2A, 3A, and 4A have a number of economizer circuits that is equal to one less than the number of compressor cylinders, systems may be designed that do not fall within this mathematical relationship but still achieve the same cooling capacity and efficiency.

Although the present invention has been described with reference to preferred embodiments, workers skilled in the art will recognize that changes may be made in form and detail without departing from the spirit and scope of the invention.

The invention claimed is:

1. A refrigeration system comprising:

an evaporator, a two-stage compressor for compressing a refrigerant, the two-stage compressor having a suction port, an interstage port, and a discharge port;

a first single-stage compressor for compressing the refrigerant, the first single-stage compressor having a suction port and a discharge port, wherein the first single-stage compressor is configured to discharge into the interstage port of the two-stage compressor;

a heat rejecting heat exchanger for cooling the refrigerant;

a first economizer circuit configured to inject refrigerant into the interstage port of the two-stage compressor, the first economizer circuit having an economizer heat exchanger and an expansion valve; and a second economizer circuit configured to inject refrigerant into the suction port of the first single-stage compressor, the second economizer circuit having an economizer heat exchanger and an expansion valve.

2. The refrigeration system of claim 1, and further comprising:

a second single-stage compressor for compressing the refrigerant, the second single-stage compressor having a suction port and a discharge port; and a third economizer circuit configured to inject refrigerant into the suction port of the second single-stage compressor.

3. The refrigeration system of claim 2, wherein the second single-stage compressor is configured to discharge into the interstage port of the two-stage compressor.

4. The refrigeration system of claim 1, wherein the two-stage compressor and the first single-stage compressor are part of a single, multi-cylinder compressor unit.

5. The refrigeration system of claim 1, wherein the heat rejecting heat exchanger is a condenser.

6. The refrigeration system of claim 1, wherein the heat rejecting heat exchanger is a gas cooler.

7. The refrigeration system of claim 1, wherein the refrigerant is carbon dioxide.

8. The refrigeration system of claim 1, wherein the economizer heat exchangers of the first and second economizer circuits form a brazed plate heat exchanger.

9. The refrigeration system of claim 1, wherein the economizer heat exchangers of the first and second economizer circuits are flash tanks.

10. The refrigeration system of claim 1, wherein the expansion valves of the first and second economizer circuits are thermal expansion valves.

11. The refrigeration system of claim 1, wherein the expansion valves of the first and second economizer circuits are electronic expansion valves.

12. A refrigeration system comprising:

an evaporator;

a two-stage compressor for compressing a refrigerant, the two-stage compressor having a suction port, an interstage port, and a discharge port;

a plurality of single-stage compressors for compressing the refrigerant, wherein one or more of the compressors is configured to discharge into the interstage port of the two-stage compressor;

a heat rejecting heat exchanger for cooling the refrigerant;

an interstage economizer heat exchanger configured to discharge into the interstage port of the two-stage compressor; and a plurality of parallel economizer heat exchangers, wherein each of the parallel economizer heat exchangers is configured to discharge into one of the plurality of single-stage compressors.

13. The refrigeration system of claim 12, wherein the two-stage compressor and the single-stage compressors are part of a single, multi-cylinder compressor unit.

14. The refrigeration system of claim 12, wherein the refrigerant is carbon dioxide.

15. The refrigeration system of claim 12, wherein the interstage and parallel economizer heat exchangers each include an expansion valve.

16. The refrigeration system of claim 15, wherein the expansion valve is a thermal expansion valve.

17. The refrigeration system of claim 15, wherein the expansion valve is an electronic expansion valve.

18. A method of operating a refrigeration system, the method comprising:

evaporating a refrigerant;

compressing the refrigerant from a lower pressure to a higher pressure in a plurality of compressors, the plurality of compressors including a two-stage compressor and at least one single-stage compressor;

cooling the refrigerant;

directing the refrigerant through a plurality of economizer heat exchangers each having a main path and an economized path;

injecting a first portion of the refrigerant from the economized path of one of the economizer heat exchangers into an interstage port of the two-stage compressor, injecting a second portion of the refrigerant from the economized path of another one of the economizer heat exchangers into a suction port of one of the single-stage compressors; and discharging the second portion of the refrigerant into the interstage port of the two-stage compressor.

19. The method of claim 18, wherein the refrigerant is carbon dioxide.

20. The method of claim 18, wherein the compressors are part of a single, multi-cylinder compressor unit.

* * * * *